US006468114B1

(12) United States Patent
Coret et al.

(10) Patent No.: US 6,468,114 B1
(45) Date of Patent: Oct. 22, 2002

(54) SECURED ACCOUNTING MODULE FOR FRANKING MACHINE

(75) Inventors: Francis Coret, Gournay sur Marne; Stéphane Le Gallo, Igny; Thierry Le Jaoudour, Verrieres le Buisson, all of (FR)

(73) Assignee: Neopost Industrie, Bagneux (FR)

( * ) Notice: Subject to any disclaimer, the term of this patent is extended or adjusted under 35 U.S.C. 154(b) by 60 days.

(21) Appl. No.: 09/710,879

(22) Filed: Nov. 14, 2000

(30) Foreign Application Priority Data

Nov. 15, 1999 (FR) ..... 99 14271

(51) Int. Cl.[7] ..... H01R 13/514
(52) U.S. Cl. ..... 439/752
(58) Field of Search ..... 439/76.1; 361/752, 361/758, 736, 737, 742, 759, 801, 804; 174/138 G

(56) References Cited

U.S. PATENT DOCUMENTS 4,650,973 A 3/1987 Pike
4,813,912 A 3/1989 Chickeas et al.
5,550,712 A * 8/1996 Crockett ..... 174/52.1
5,920,459 A * 7/1999 Weber et al. ..... 361/752
5,978,232 A * 11/1999 Jo ..... 211/41.17
6,249,442 B1 * 6/2001 Watanabe ..... 174/138 E
6,327,156 B1 * 12/2001 Wangen ..... 174/138 G

FOREIGN PATENT DOCUMENTS

DE 32 41 067 A1 5/1984
EP 0 820 041 A2 1/1998

* cited by examiner

*Primary Examiner*—Brian Sircus
*Assistant Examiner*—Phuong K T Dinh
(74) *Attorney, Agent, or Firm*—Sughrue Mion, PLLC

(57) ABSTRACT

This invention relates to a secured accounting module of a franking machine comprising a printed circuit card intended to receive accounting circuits and mounted between a module base and a module cover, the base including a plurality of crimping studs on which the card is fitted and which are intended to cooperate with locking bushes fast with the cover; an insert ring interposed between each crimping stud and the corresponding locking bush; a first connector for connecting this insert ring with the cover, after the cover has been force-fitted on the base; and a second connector for connecting this insert ring with the base, after the cover has been force-fitted on the base.

11 Claims, 3 Drawing Sheets

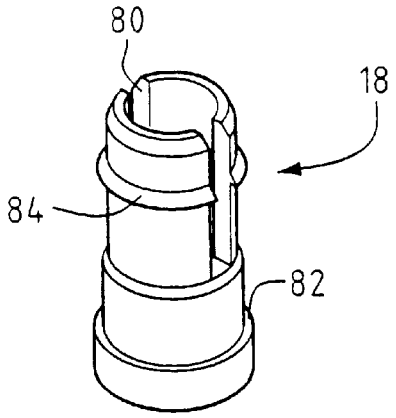
FIG.3
FIG.4
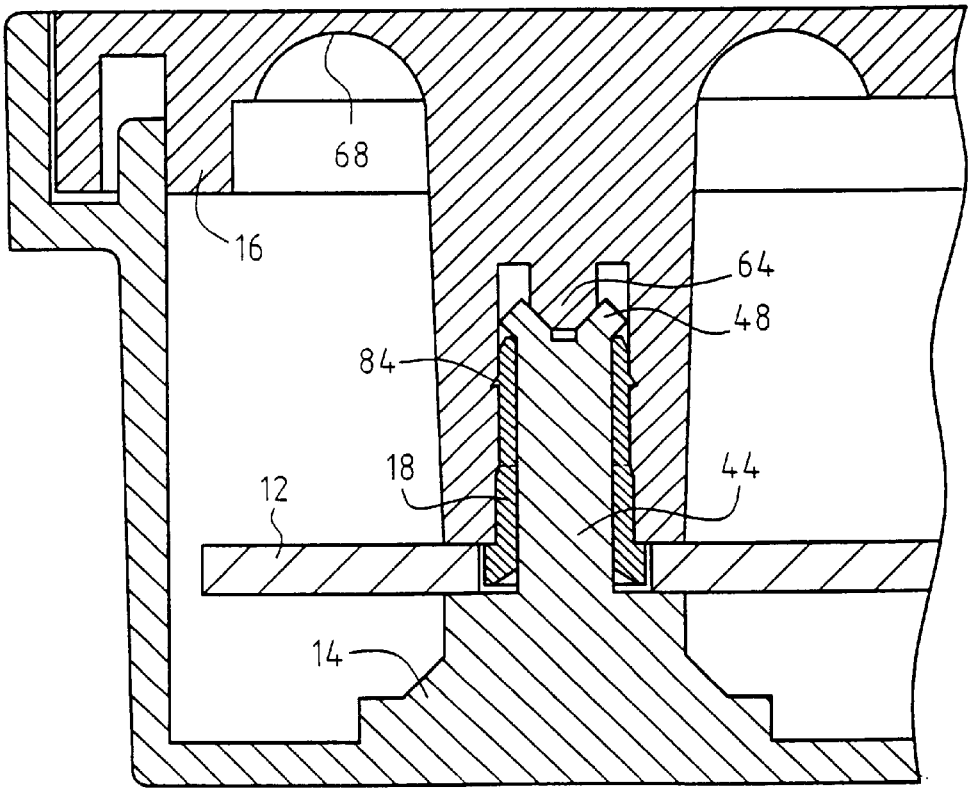

SECURED ACCOUNTING MODULE FOR FRANKING MACHINE

FIELD OF THE INVENTION

The present invention relates to the domain of mail processing and more particularly to a secured accounting module for a franking machine.

BACKGROUND OF THE INVENTION

It is known that the accounting module, which comprises in particular the reversible meters of a franking machine, is a sensitive element of this machine which must be protected against any fraudulent access. Now, the production of a module which is really physically tamperproof comes up against numerous technical problems.

In effect, firstly, the means for assembling the module must not be easily, or, better, must not be at all detectable from the outside. Secondly, once assembled, the module must be virtually non-dismountable. Lastly, if dismounting of the module were nonetheless attempted, it is important that any attempt at opening can be detected.

It is an object of the present invention to overcome the problems set forth hereinabove by proposing a secured accounting module of a particularly tamper-proof franking machine. Another object of the invention is to provide such impregnability simply and without requiring a complex process of manufacture.

SUMMARY OF THE INVENTION

These objects are attained by a secured accounting module of a franking machine comprising a printed circuit card intended to receive accounting circuits and mounted between a module base and a module cover, said base comprising a plurality of crimping studs on which said card is fitted and which are intended to cooperate with locking bushes fast with said cover, characterized in that it further comprises:

- an insert ring interposed between each crimping stud and the corresponding locking bush
- first connection means for connecting this insert ring with said cover, after said cover has been force-fitted on said base, and
- second connection means for connecting this insert ring with said base, after said cover has been force-fitted on said base.

By this specific assembly structure which is produced internally, the assembly means cannot be detected from the outside, which makes it all the more difficult to disconnect them without causing destruction.

Said first connection means between said insert ring and said cover comprise a flange forming an integral part of said insert ring and intended to penetrate said locking bush when said cover is force-fitted on said base and said second connection means fast said insert ring and said base comprise an annular element forming an integral part of said crimping stud and intended to retain said insert ring by crimping, when said cover is force-fitted on said base. Said flange is preferably formed at the level of an end part of the insert ring.

Said locking bush advantageously comprises at its base a lug intended to cooperate with said annular element in order to move it apart and bend it against said insert ring.

Said insert ring is further provided with a transverse groove to give it sufficient elasticity when it is introduced in said locking bush. It is made of a material whose hardness is greater than that of the materials forming the base and the cover of the module. This material is preferably stainless steel.

According to an advantageous variant embodiment, the secured accounting module according to the invention may comprise areas of lesser resistance formed either around each of said locking bushes of the cover or around each of said crimping studs of the base and intended to break upon any attempt to separate said cover from said base.

The present invention also relates to a franking machine equipped with a secured accounting module.

BRIEF DESCRIPTION OF THE DRAWINGS

The invention will be more readily understood on reading the following description given by way of non-limiting example, with reference to the accompanying drawings, in which:

FIG. 3 is a view in perspective of an insert element ensuring tamper-proof assembly of the secured accounting module according to the invention, and FIG. 4 is a detailed view after assembly of the secured accounting module of FIG. 2.

DESCRIPTION OF PREFERRED EMBODIMENT

Figure 1:
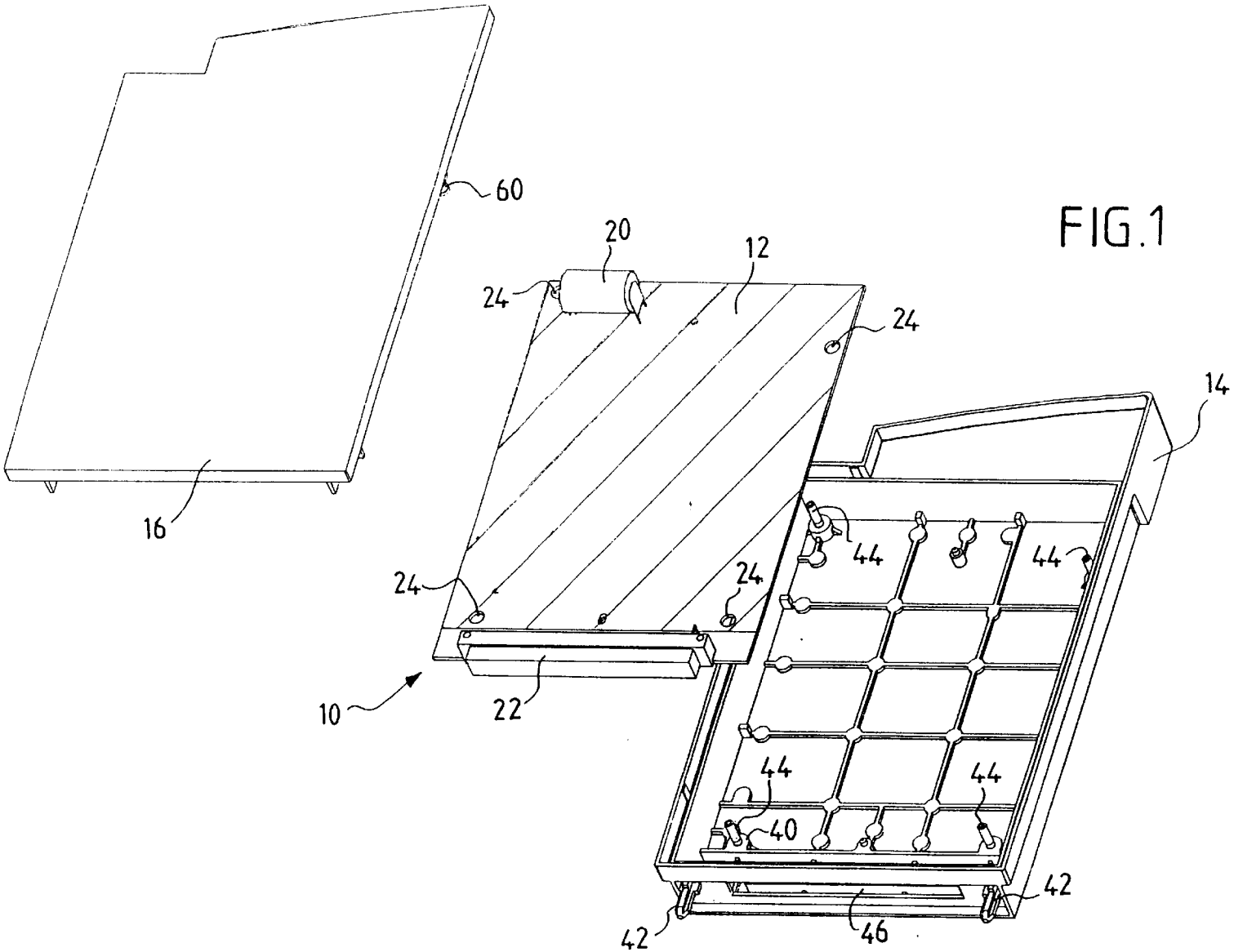
FIG. 1 is an exploded view in perspective of a secured accounting module according to the invention.

Referring now to the drawings, FIG. 1 firstly shows a view in perspective of a secured accounting module according to the invention, intended to equip a franking machine (not shown).

This module 10 comprises a printed circuit card 12 mounted between a module base 14, on whose shoulder 40 it rests, and a module cover 16. On the card 12 are mounted different electronic circuits (meters, memories, clock-calender, encrypting means) necessary for metering the frankings (for example the integrated circuit 20) and a multi-pin connector 22 for connection to the base (not shown) of the franking machine. The base 14 comprises for example two centering studs 42 intended to position the module precisely with respect to the base, in order that the connector 22, which passes through the base 14 via an opening 46, is in register with a corresponding receiving socket (not shown) in the base.

The base 14 also comprises a plurality of studs 44 on which is fitted the card 12 provided with through orifices 24 thereopposite and which are intended to receive locking bushes 60 fast with the cover 16 and whose outer face 62 is intended to press the card 12. It will be noted that a simple force-fitting of the studs of the base in the corresponding locking bushes of the cover is not sufficient to ensure final, and therefore non-dismountable, assembly of the accounting module. In effect, a zinc alloy, such as Z-A4U1G (called Zamac 5) can creep during such force-fitting and consequently a physical impregnability of the module is not guaranteed. Moreover, a dismounting of the module following by a re-assembly thereof would in that case be difficult to detect.

Figure 2:
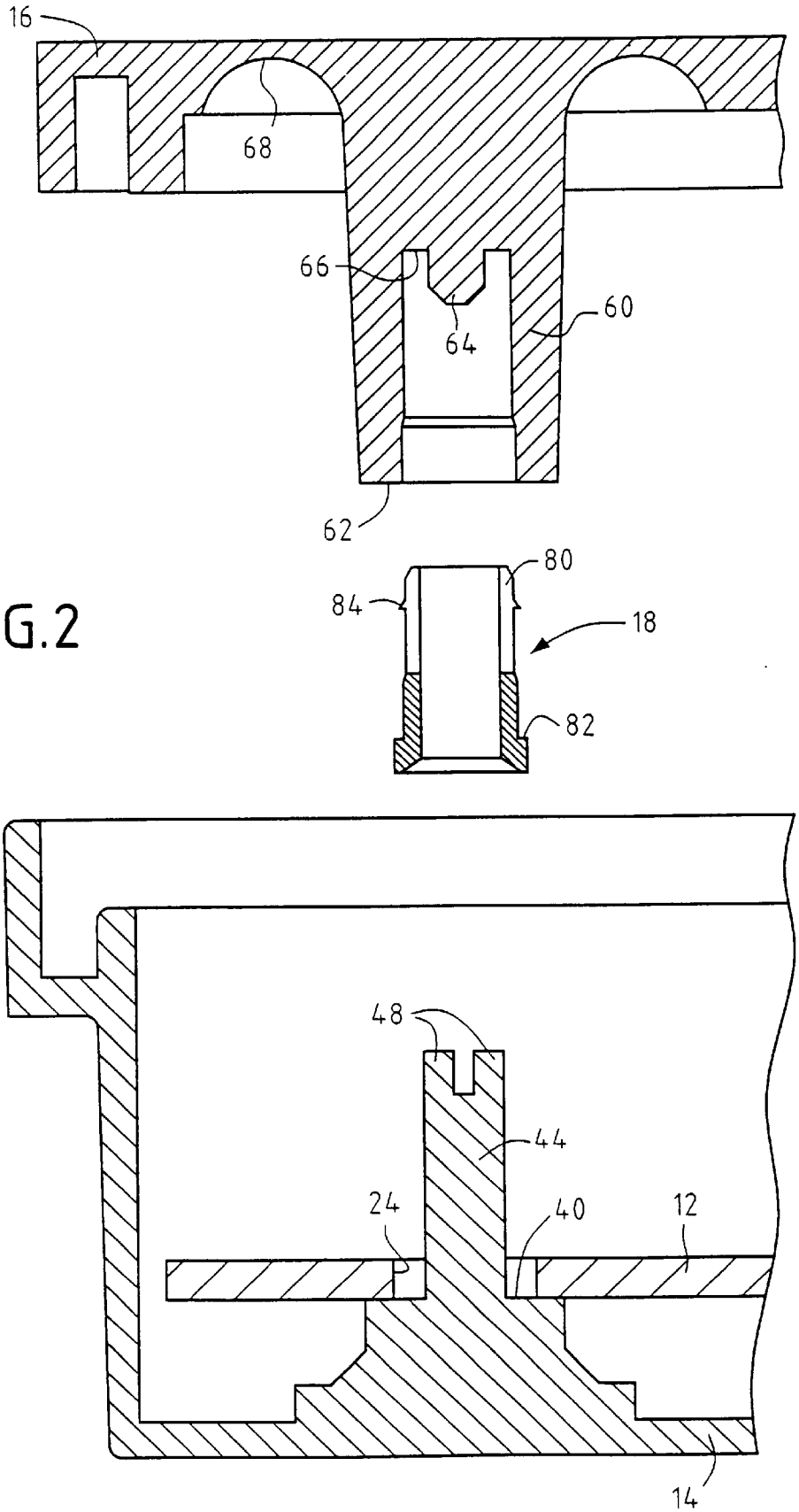
FIG. 2 is a detailed view before assembly of the secured accounting module of FIG. 1.

As shown in FIGS. 2 and 3, and according to the invention, an insert ring 18 is provided, interposed between each stud 44 and the corresponding locking bush 60 and, on the one hand, provided with a transverse groove 80 and, on the other hand, comprising in its lower part a shoulder 82 and in its upper end part a flange 84 (this flange forms the first connection means for connecting the insert ring with the cover). This insert ring is made of a material, for example a stainless steel X6CrMoS17, which presents a hardness greater than that of the material forming the cover and the base, for example a zinc alloy Z-A4U1G.

In addition, in order to make a stud/insert ring connection by crimping, he stud 44 is pierced in its end part in order to form an annular element 48 which will be moved apart by an advantageously truncated lug 64 emerging from the bottom 66 of the locking bush and bent against the insert ring 18, when the cover 16 is force-fitted on the base 14 (for example using a press). This annular element to some extent forms the second connection means for connecting this insert ring with the base, the combination of the first (cover/insert ring connection) and second (insert ring/base connection) connection means in that case ensuring complete connection of the cover with the base.

The module cover further comprises areas 68 of lesser resistance formed around each of the studs forming crimping studs and intended to break upon any attempt to open the module by separating the cover of the module from the base thereof.

The module is assembled as follows: The card 12 is firstly fitted on the crimping studs 44 of the base 14 and positioned on the shoulder 40. To that end, the through orifices 24 of the card obviously present a diameter slightly greater than that of these studs. The insert rings 18 which present an outer diameter greater than the inner diameter of the locking bushes 60 are then introduced in these bushes until their shoulders 82 come into abutment with the outer faces 62 of the bushes. This introduction is rendered possible by the presence of the transverse groove 80 which provides sufficient elasticity for the inserts whose end will thus close slightly towards their longitudinal axis.

When the cover 16 with its locking bushes 60 provided with their respective insert rings 18 descends on the crimping studs 44 during a force-fitting operation employing a press, an intimate bond will be provoked by creeping between this insert ring, and particularly its flange 84, and the locking bush, said flange penetrating in the material constituting the bush, as illustrated in FIG. 4. Simultaneously to this action of expansion of the insert ring, there is produced an action of crimping by the lug 64 which, when the cover 16 is descending, will move the annular element 48 of the crimping stud 44 apart and bend it against the insert ring 18 in order to retain it and thus prevent disconnection of the cover from the base. In this way, the card 12 is pressed between the base 14 and the cover 16, which have then become inseparable. Any dismounting becomes totally impossible unless the module is inevitably and irreversibly deteriorated.

In effect, it will be readily appreciated that any traction exerted on the cover 16 or the base 14 will, from a certain threshold of intensity, leave a circular trace of rupture on the cover around the locking bushes 60 (at the level of the areas 68 of lesser resistance), indicating an attempt at fraud. It will be noted that, although such areas have been formed around the locking bushes, it is obvious that they could equally well have been formed on the base around the crimping studs.

What is claimed is:

1. A secured accounting module of a franking machine comprising a printed circuit card intended to receive accounting circuits and mounted between a module base and a module cover, said base comprising a plurality of crimping studs on which said card is fitted and which are intended to cooperate with locking bushes fast with said cover, wherein said secured accounting module further comprises:

an insert ring interposed between each crimping stud and a corresponding locking bush, first connection means for connecting the insert ring with said cover, after said cover has been force-fitted on said base, and second connection means for connecting this insert ring with said base, after said cover has been force-fitted on said base.

2. The secured accounting module of claim 1, wherein said first connection means comprise a flange forming an integral part of said insert ring, said flange penetrating said locking bush when said cover is force-fitted on said base.

3. The secured accounting of claim 2, wherein said flange is formed at the level of an end part of the insert ring.

4. The secured accounting module of claim 1, wherein said second connection means comprise an annular element forming an integral part of said crimping stud for retaining said insert ring by crimping when said cover is force-fitted on said base.

5. The secured accounting module of claim 4, wherein said locking bush comprising at its base a lug intended to cooperate with said annular element in order to move it apart and bend it against said insert ring.

6. The secured accounting module of claim 1, wherein said insert ring is further provided with a transverse groove.

7. The secured accounting module of claim 1, wherein said insert ring is made of a material having a hardness that is greater than that of the materials forming the base and the cover of the module.

8. The secured accounting module of claim 7, wherein said insert ring is made of stainless steel.

9. The secured accounting module of claim 1, wherein said module cover further comprises areas of lesser resistance formed around each of said locking bushes to break upon any attempt to separate said cover from said module base.

10. The secured accounting module of claim 1, wherein said module base further comprises areas of lesser resistance formed around each of said crimping studs to break upon any attempt to separate said cover from said module base.

11. A franking machine equipped with the secured accounting module of claim 1.

* * * * *